US005465430A

United States Patent [19]

Davis et al.

[11] Patent Number: 5,465,430

[45] Date of Patent: Nov. 14, 1995

[54] CAP GLIDE PULLER

[76] Inventors: Carl L. Davis, P.O. Box 486, Livingston Manor, N.Y. 12758-0486; George Spector, 233 Broadway Rm 702, New York, N.Y. 10279

[21] Appl. No.: 303,732

[22] Filed: Sep. 9, 1994

[51] Int. Cl.[6] ..... B66F 15/00

[52] U.S. Cl. ..... 29/267; 81/3.56; 81/3.57; 259/129; 259/130

[58] Field of Search ..... 81/3.55, 3.56, 81/3.57; 29/267, 129, 130, 120, 121, 15, 17, 113

[56] References Cited

U.S. PATENT DOCUMENTS 1,211,233 1/1917 Rhonemus ..... 81/3.56

1,530,810 3/1925 Bracey ..... 81/3.57

4,334,669 6/1982 Rass ..... 254/130

5,163,346 11/1992 Zenner ..... 81/3.55

*Primary Examiner*—Robert C. Watson

[57] ABSTRACT

A cap glide puller comprising an elongated handle. A head is longitudinally offset at one end of the handle. A hook diagonally extends downwardly from the offset end of the handle towards the head. The head and the hook are capable of engaging a cap glide on a free end of a chair leg. When the handle is manually lifted up, the cap glide will be removed from the free end of the chair leg.

3 Claims, 1 Drawing Sheet

CAP GLIDE PULLER

BACKGROUND OF THE INVENTION

The instant invention relates generally to pushing and pulling implements and more specifically it relates to a cap glide puller which provides a structure to remove cap glides from furniture.

There are available various conventional pushing and pulling implements which do not provide the novel improvements of the invention herein disclosed.

SUMMARY OF THE INVENTION

A primary object of the present invention is to provide a cap glide puller that will overcome the shortcomings of the prior art devices.

Another object is to provide a cap glide puller in which a tool is structured to remove cap glides from furniture and similar articles, quickly and with little effort applied.

An additional object is to provide a cap glide puller in which the head and hook portions are adjustable to accommodate different sized cap glides that must be removed.

A further object is to provide a cap glide puller that is simple and easy to use.

A still further object is to provide a cap glide puller that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
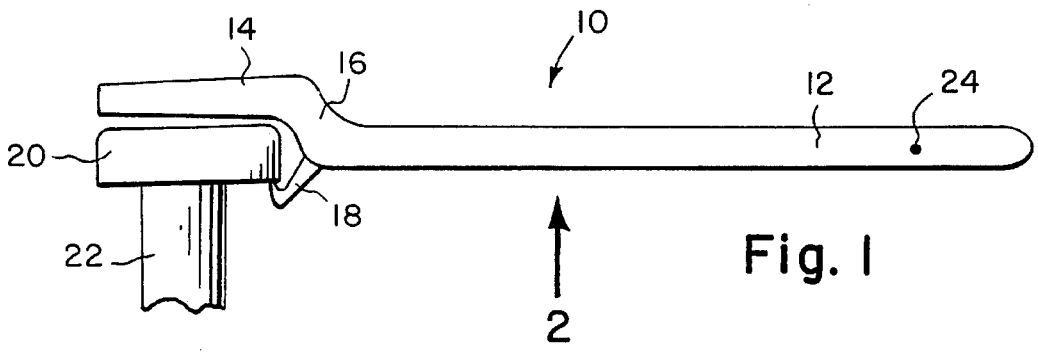
FIG. 1 is a side view of the instant invention removing a cap/glide from a furniture leg.
Figure 2:
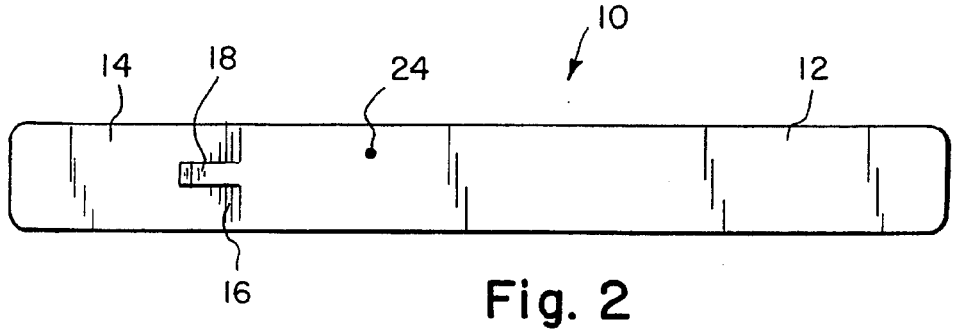
FIG. 2 is a bottom view taken in the direction of arrow 2 in FIG. 1.

Turning now descriptively to the drawings, in which similar reference characters denote similar elements throughout the several views, FIGS. 1 and 2 illustrate a cap glide puller 10 comprising an elongated handle 12. A head 14 is longitudinally offset at one end 16 of the handle 12. a hook 18 diagonally extends downwardly from the offset end 16 of the handle 12 towards the head 14. The head 14 and the hook 18 are capable of engaging a cap glide 20 on a free end of a chair 22. When the handle 12 is manually lifted up, the cap glide 20 will be removed from the free end of the chair leg 22.

Figure 3:
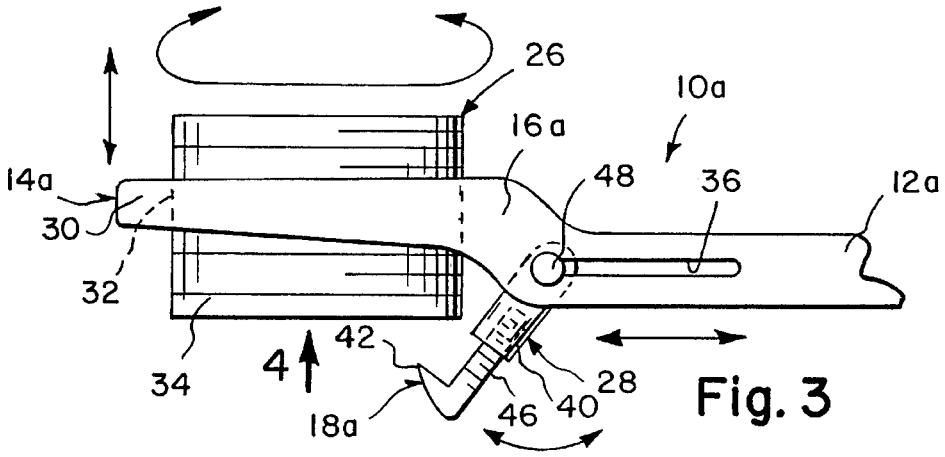
FIG. 3 is an enlarged side view of a modification with the handle broken away in which the head and hook are adjustable for different sized cap glides.
Figure 4:
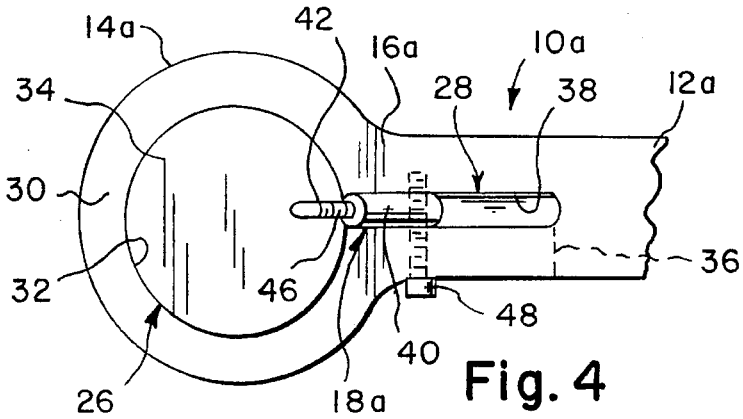
FIG. 4 is a reduced bottom view taken in the direction of arrow 4 in FIG. 3.

The handle 12, the head 14 and the hook 18 are integral and made out of a durable strong material 24, such as stainless steel and the like. A modified cap glide puller 10*a*, as shown in FIGS. 3 and 4, contains a structure 26 for adjusting the head 14*a*. An assembly 28 is for adjusting the hook 18*a*, so as to accommodate different sized cap glides 20 that are to be removed from the free end of the chair leg 22.

The head adjusting structure 26 consists of the head 14*a* being an enlarged flat disc 30 having a large threaded aperture 32 therethrough. A large threaded shank 34 engages within the large threaded aperture 32 in the enlarged flat disc 30 of the head 14*a*, so as to change the depth of the head 14*a*.

The hook adjusting assembly 28 includes the handle 12*a* having a side slot 36 and an intersecting right angle bottom slot 38 adjacent the offset end 16*a*. The hook 18*a* is separated into a first segment 40 and a second segment 42. The first segment 40 has an internally threaded bore 44 and is slideable in the bottom slot 38. The second segment 42 is externally threaded at 46 to adjustably engage with the internally threaded bore 44. A setscrew 48 extends into the side slot 36 and through the first segment 40 of the hook 18*a*, so as to retain the first segment 40 in a stationary angled position with respect to the head 14*a*.

OPERATION OF THE INVENTION

To use the cap glide puller 10 a person simply turns the chair leg 22 upside down, so that the cap glide 20 is on top. The head 14 and the hook 18 can engage with the cap glide 20. When the handle 12 is lifted up, the cap glide 20 will be removed.

To use the cap glide puller 10*a* a person adjusts the large threaded shank 34 in the head 14*a*. The second segment 42 is then adjusted to the first segment 40 of the hook 18*a*. The first segment 40 is then positioned in the bottom slot 38. The setscrew 48 is then tightened to hold the hook 18*a* in its stationary angular position. The cap glide 20 is then removed from the chair leg 22 in the same way as the cap glide puller 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A cap glide puller comprising:

a) an elongated handle;

b) a head longitudinally offset at one end of said handle;

c) a hook diagonally extending downwardly from the offset end of said handle towards said head, with said head and said hook capable of engaging a cap glide on a free end of a chair leg, so that when said handle is manually lifted up, the cap glide will be removed from the free end of the chair leg;

d) means for adjusting said head and e) means for adjusting said hook, so as to accomodate different sized cap glides that are to be removed from the free end of the chair leg.

2. A cap glide puller as recited in claim 1, wherein said head adjusting means includes:

a) said head being an enlarged flat disc having a large threaded aperture therethrough and b) a large threaded shank to engage within said large threaded aperture in said enlarged flat disc of said head, so as to change the depth of said head.

3. A cap glide puller as recited in claim 2, wherein said hook adjusting means includes:

a) said handle having a side slot and an intersecting right angle bottom slot adjacent the offset end;

b) said hook separated into a first segment and a second segment, wherein said first segment has an internally threaded bore and is slideable in said bottom slot, while said second segment is externally threaded to adjustably engage with said internally threaded bore and c) a setscrew to extend into said side slot and through said first segment of said hook, so as to retain said first segment in a stationary angled position with respect to said head.

* * * * *